United States Patent [19]

Kiyonaga

[11] Patent Number: 4,577,868

[45] Date of Patent: Mar. 25, 1986

[54] GOLF SWING TRAINING DEVICE WITH VISUAL AND AUDIBLE ALERTS

[76] Inventor: Norio Kiyonaga, 4-13-1 Iwatominami, Komae-shi, Tokyo, Japan

[21] Appl. No.: 598,459

[22] Filed: Apr. 9, 1984

[30] Foreign Application Priority Data

Apr. 15, 1983 [JP] Japan ..... 58-65284

[51] Int. Cl.[4] ..... A63B 69/36

[52] U.S. Cl. ..... 273/183 A; 273/26 R

[58] Field of Search ..... 273/32 C, 187 R, 187 A, 273/187 B, DIG. 28, 195 R, 186 C, 183 A, 183 B, 26 R; 272/DIG. 9

[56] References Cited

U.S. PATENT DOCUMENTS

| | | | |
|---|---|---|---|
| 3,169,022 | 2/1965 | Kretsinger | 273/26 R |
| 3,352,559 | 11/1967 | Larsen | 273/195 R |
| 4,023,810 | 5/1977 | Lorang | 273/186 C |
| 4,248,431 | 2/1981 | Burnes | 273/187 R |
| 4,285,517 | 8/1981 | Morrison | 273/1 GC |
| 4,304,406 | 12/1981 | Cromarty | 273/187 R |

OTHER PUBLICATIONS

Lord, M. et al., "Video Aid to Rehabilitation of Standing Balance", Med. & Biol. Eng. & Comput., May 1982, vol. 20, #3, pp. 281-285.

*Primary Examiner*—Richard C. Pinkham
*Assistant Examiner*—MaryAnn Stoll Lastova
*Attorney, Agent, or Firm*—Frishauf, Holtz, Goodman & Woodward

[57] ABSTRACT

A golf swing practice device comprises a pair of sensors for detecting the golfer's weight placed on address plates, a first circuit having a memory element for recording the proper weight shift during the course of a golf swing, and a second circuit having two sound generating elements providing output signals to generate three successive advising sounds from a chime. The interval of time between the generation of the first and second sounds may be adjusted by a regulator whereby the golfer may take the proper timing when initiating the downswing at the completion of the backswing. Further, the three successive sounds may be generated from a chime connected to the second circuit.

2 Claims, 10 Drawing Figures

GOLF SWING TRAINING DEVICE WITH VISUAL AND AUDIBLE ALERTS

BACKGROUND OF THE INVENTION

1. Field of the Invention

The present invention relates to a golf swing practice device and, particularly, to a device of the type which provides alerting sounds enabling a golfer to execute a golf swing with the proper timing and rhythm.

2. Description of the Prior Art

In order to execute a proper golf shot, a golfer is required to establish a proper grip of the hands on a golf club, to establish a proper stance, to keep his eyes on the ball, to maintain the proper timing by which a downswing is initiated at the completion of a backswing or to maintain the proper rhythm in a golf swing, and the like. The golfer may visually confirm whether or not the correct grip or stance is established. Accordingly, if improperly established, corrections may be made based upon the information derived from instructors or instruction booklets. As to the above-mentioned grip or stance, however, the golfer is unable to confirm visually whether or not the proper timing or rhythm in the golf swing are maintained in a consistent manner, in that such is a matter of "feeling". Therefore, corrections of the improper timing or rhythm may not readily be accomplished by any means except a considerable amount of practice.

It should be mentioned that the proper golf swing involves a series of movements that begins with an address, continues with a backswing, a downswing, an impact and a follow-through, and ends up with a finish. As stated above, such a series of movements must be executed with the proper timing and rhythm. Above all, the tempo from the address to the top of the backswing during which the golfer's weight has completely shifted to the right foot, and timing by which the downswing, is initiated at the completion of the backswing are by far the most important factors of all. In other words, the perfection of the golf swing may be achieved when such tempo and timing are properly maintained in a consistent manner.

A wide variety of golf swing practice devices have been proposed by the prior art to execute the proper golf swing by limiting or controlling hand or leg movements during the golf swing. However, such prior art devices provide no means for teaching the proper timing and rhythm in the golf swing, especially the timing by which the downswing is initiated at the completion of the backswing.

BRIEF SUMMARY OF THE INVENTION

It is, therefore, a primary object of the present invention to provide a golf swing practice device enabling a golfer to execute a golf swing with the proper timing and rhythm, especially with the aid of alerting sounds.

BRIEF DESCRIPTION OF THE DRAWING

These and other objects of the present invention will be more clear from the following description with reference to the accompanying drawing, wherein.

DETAILED DESCRIPTION OF THE INVENTION

Figure 1:
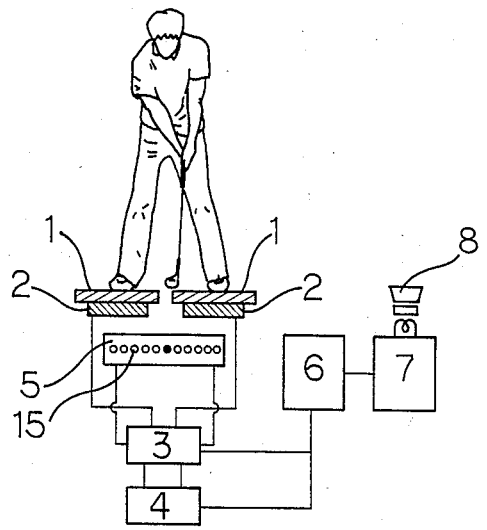
FIG. 1 is a schematic block diagram illustrating the construction of a golf swing practice device according to the present invention.
Figure 2:
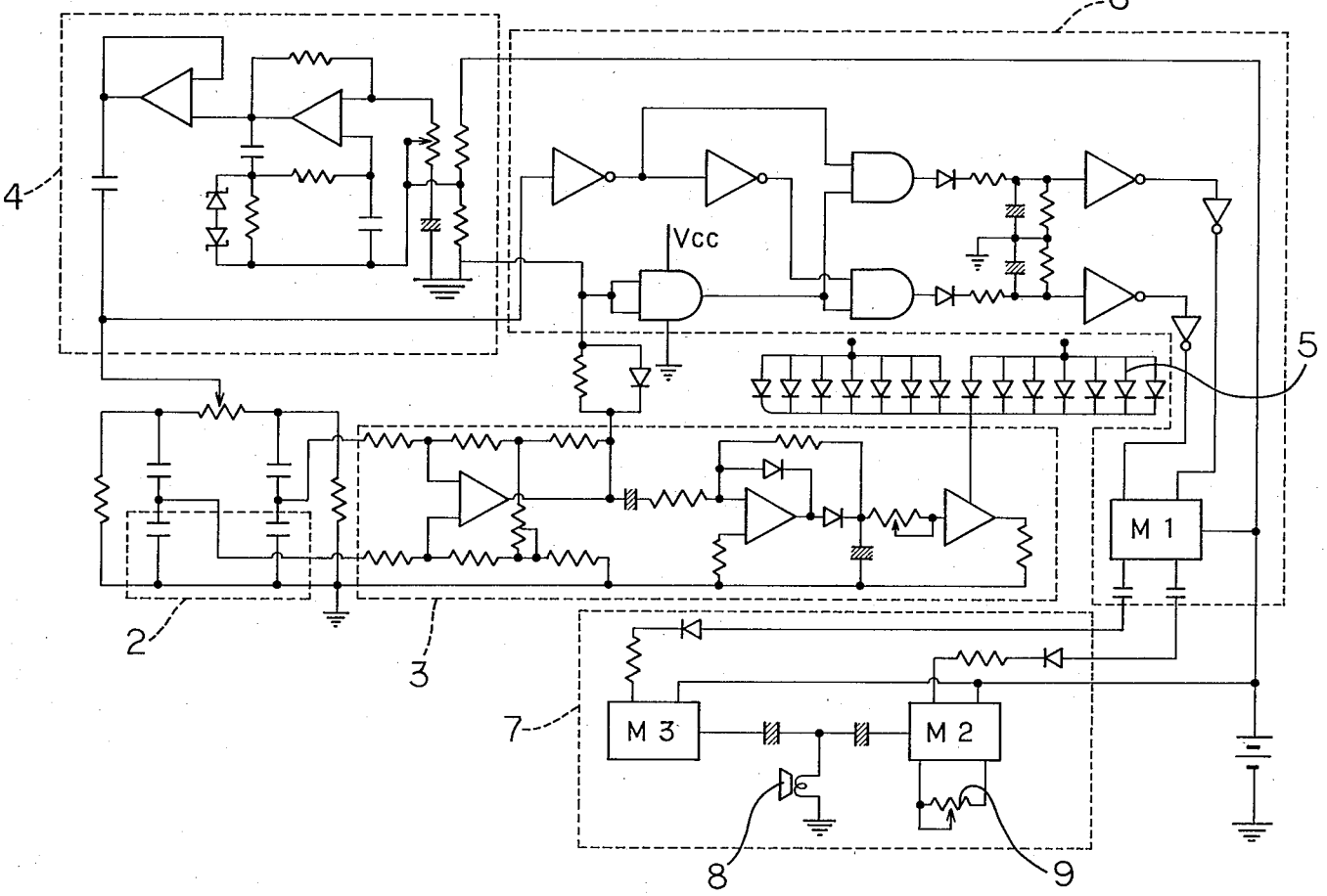
FIG. 2 is a circuit diagram of the preferred embodiment of the present invention.
Figure 3:
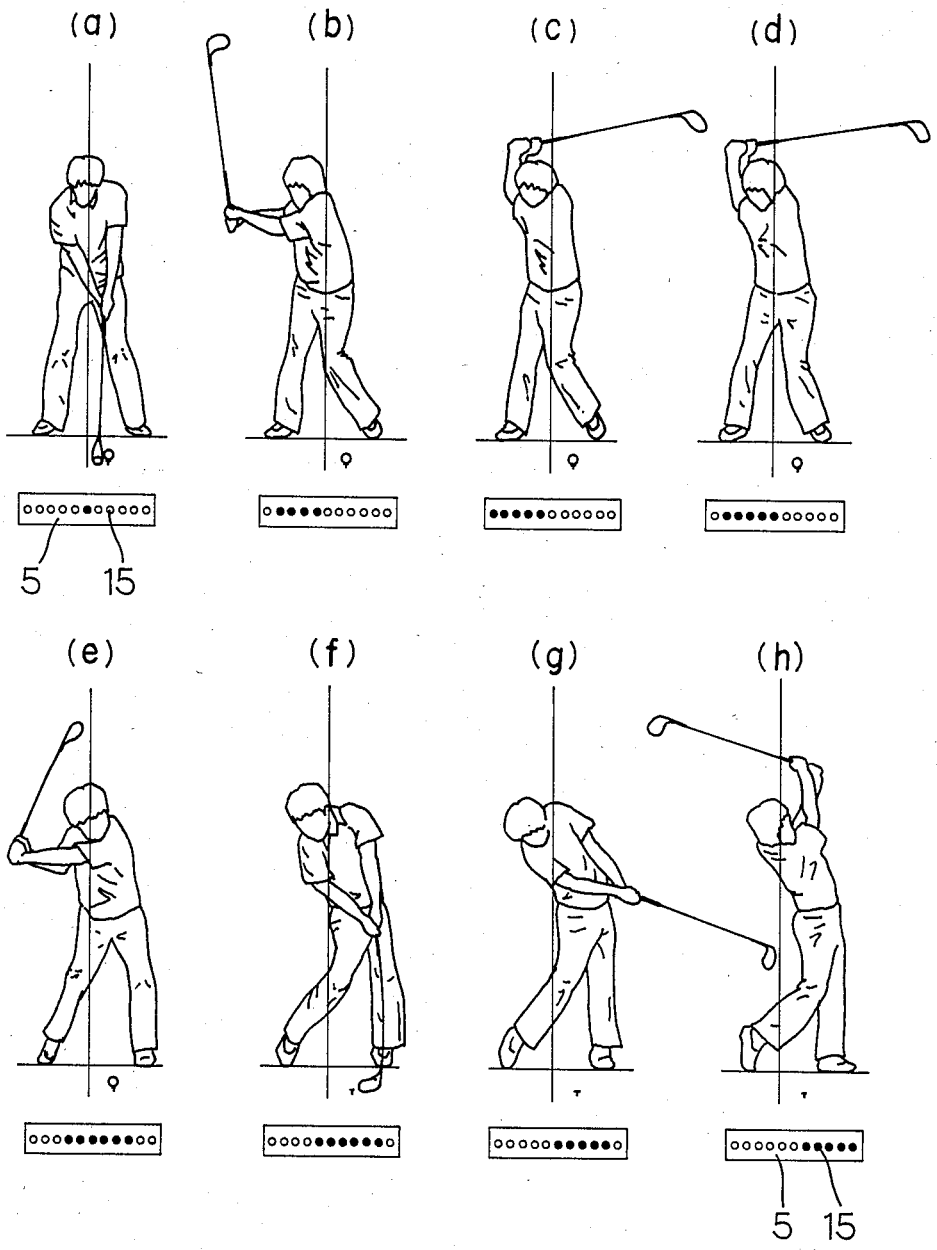
FIGS. 3(*a*)–3(*h*) illustrate lighting patterns as seen on the front panel of a weight shift indicator, corresponding to the weight placed on address plates during the course of a golf swing.

As illustrated in FIG. 1, positioned underneath a pair of address plates (1),(1) are a pair of sensors (2),(2) for sensing a golfer's weight when standing on the plates. When the golfer, for instance, of 60 kg in weight stands proportionally on these address plates (1),(1), both sensors (2),(2) are adapted to sense 30 kg respectively. Said sensors (2),(2) are connected to an amplifier circuit (3) for amplifying signals developed by said sensors (2),(2) corresponding to the weight placed on said address plates (1),(1), and to an oscillating circuit (4) respectively. Said amplifier circuit (3) is provided with a weight shift indicator (5) so that the golfer may learn the relative weight distribution of the two feet during the golf swing with the aid of a predetermined lighting pattern of a plurality of indicator lights (15). Said weight shift indicator (5) is placed in front of the address plates (1),(1). As is clear in FIG. 3, when the golfer's weight is proportionally placed on the address plates (1),(1), the indicator lights in the central region of the row of indicator lights (15) are adapted to be lighted. As the weight is shifted to the right foot, the indicator lights in the right region of said row of indicator lights (15) are adapted to be lighted progressively. Conversely, as the weight is shited to the left foot, the indicator lights in the left region of said row of indicator lights (15) are adapted to be lighted progressively. Accordingly, the golfer may visually confirm, with the aid of the weight shift indicator (5), whether the weight is properly shifted to the right foot during an address in FIG. 3*a* to a backswing in FIG. 3*c*, or whether the weight is properly shifted to the left foot during such movements of the golf swing as from the top of the backswing in FIG. 3*d* to a finish in FIG. 3*h* by way of a downswing in FIG. 3*e*, an impact in FIG. 3*f* and a followthrough in FIG. 3*g*.

A first circuit (6) is connected to said amplifier circuit (3) and oscillating circuit (4). Said first circuit (6) comprises a memory element M1 which records the state of a proper weight shift to the right foot during the backswing movements as shown in FIG. 3*b* through FIG. 3*c* and the state of a proper weight shift to the left foot during the movements as shown in FIG. 3*f* through FIG. 3*h* by means of the signals from said sensors (2),(2).

Said second circuit (7) includes a sound generating element M2 which develops a signal for a "first sound" representing the state of the proper weight shift to the right foot and a sound generating element M3 which develops a signal for a "third sound" representing the state of the proper weight shift to the left foot during the movements of the golf swing as shown in FIGS. 3*e* through 3*h*. Said sound generating element M2 also develops another signal for a "second sound" representing the proper timing by which the downswing is initiated with an instantaneous "pose" after the backswing is completed. The sound generating element M2 is provided with a regulator (9) so that an interval of time between the first and the second sounds is adjustable by means thereof. The adjustment may be made depending upon the timing which the golfer may take when the downswing is initiated at the completion of the backswing. Further, each of said first, second and third sounds is adapted to be generated from a chime (8) connected to the second circuit (7). It is, of course, understood that the use of the chime constitutes the preferred embodiment of the present invention, although any suitable form of sound generating means may alternatively be employed.

As is clear from the preceding paragraphs, when the weight is properly shifted to the right foot during the backswing movements as shown in FIG. 3*b* through FIG. 3*c*, the first sound may be generated from the chime (8) by means of the sound generating element M2. Subsequently thereafter, the second sound may be generated with the instantaneous "pose" preselected by the regulator (9) so as to inform the golfer of the proper timing by which the downswing is to be initiated at the completion of the backswing. Furthermore, when the weight is poperly shifted to the left foot at the completion of the golf swing, the sound generating element M3 receives the signal from the memory element M1 and develops the signal for the third sound. The above-mentioned three sounds may successively be generated with a predetermined interval of time between each sound when the weight shift, first to the right foot and then to the left foot, is properly executed during the course of the golf swing in FIG. 3*a* through FIG. 3*h*. When, however, the weight shift to the right foot during the backswing or to the left foot after the impact, is improperly executed, the three sounds may not be generated.

As hereinabove stated, the golf swing practice device according to the present invention is intended to check the proper weight shift during the course of the golf swing and to generate three successive sounds serving as a guide to execution of a proper golf swing with the proper timing and rhythm. Thus, the golfer may learn that when the three successive sounds are not generated, the weight is not properly shifted either to the right foot or to the left foot. In addition, in the golf swing practice device according to the present invention, after the first sound is generated, the interval of time between the generation of the first and the second sounds may be preset. Accordingly, by taking advantage thereof, the proper timing and rhythm in the golf swing may be acquired in a consistent manner.

While the present invention has been described with reference to a single embodiment, it will be apparent that changes and modifications may be made without departing from the spirit and scope of the invention.

What is claimed is:

1. A golf swing practice device, comprising:

a pair of address plates for supporting the two feet of a golfer at address;

a pair of sensors operatively positioned beneath said pair of address plates for producing signals corresponding to the weight placed on said address plates;

a first circuit coupled to said sensors and including a memory element adapted to record the relative weight distribution of the two feet of the golfer during the course of a golf swing in response to the signals produced by said sensors;

a second circuit including a first sound generating element operative to develop signals for a first sound representing a state in which the golfer's weight is properly shifted to the right foot and a second sound representing a proper timing at which a downswing is initiated upon completion of a backswing by the golfer, and a second sound generating element operative to develop a third sound representing a state wherein the golfer's weight is properly shifted to the left foot, and sound means for generating said first, said second and said third sounds; and regulator means associated with said first sound generating element for enabling an interval of time between said first and said second sounds to be adjusted by the golfer.

2. A device for indicating the weight distribution of a golfer and alerting the golfer of proper timing to initiate a downswing at the completion of a backswing, comprising:

a pair of address plates adapted to support the feet of a golfer;

a pair of sensors mounted on the undersides of said address plates and adapted to develop signals in response to a golfer's weight as applied by the golfer's feet on said plates;

a first circuit including a memory element adapted to record distribution of the golfer's weight between the feet of the golfer during all phases of a golf swing based on the signals developed by said sensors;

a second circuit operatively connected to the first circuit and including a first sound generating element for developing signals for a first sound and a second sound, said first sound being representative of a proper distribution of the golfer's weight to the right in conjunction with a backswing, and said second sound being representative of a proper timing to initiate a downswing at the completion of the backswing; and a second sound generating element for developing a signal for a third sound which is representative of a proper distribution of the golfer's weight to the left on the downswing through a finish;

a weight distribution indicator including a plurality of indicator lamps adapted to indicate the relative weight distribution of the golfer during the golf swing;

means electrically connected to the second circuit, for generating said first, said second and said third sounds in a sequential manner with certain time intervals therebetween in response to the signals developed by the sound generating element, and only in the event that a proper distribution of the golfer's weight is effected through the golf swing; and regulator means adapted to adjust the interval of time between the first sound and the second sound.

* * * * *